US012005305B2

(12) United States Patent
Takeda et al.

(10) Patent No.: US 12,005,305 B2
(45) Date of Patent: Jun. 11, 2024

(54) PEDALING EXERCISE DEVICE

(71) Applicant: TOYOTA JIDOSHA KABUSHIKI KAISHA, Toyota (JP)

(72) Inventors: Takahiro Takeda, Toyota (JP); Eisuke Aoki, Toyota (JP); Tadashi Odashima, Toyota (JP); Yusuke Ano, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/709,774

(22) Filed: Mar. 31, 2022

(65) Prior Publication Data

US 2022/0331654 A1 Oct. 20, 2022

(30) Foreign Application Priority Data

Apr. 14, 2021 (JP) ..... 2021-068525

(51) Int. Cl.

| | |
|---|---|
| ***A63B 22/06*** | (2006.01) |
| ***A63B 21/00*** | (2006.01) |
| ***A63B 21/005*** | (2006.01) |
| ***A63B 22/20*** | (2006.01) |

(52) U.S. Cl.

CPC ..... *A63B 22/0694* (2013.01); *A63B 21/0056* (2013.01); *A63B 21/4034* (2015.10); *A63B 22/201* (2013.01)

(58) Field of Classification Search

CPC ..... A63B 22/0664; A63B 22/0694; A63B 2022/067; A63B 2022/0676

See application file for complete search history.

(56) References Cited

U.S. PATENT DOCUMENTS

| | | | | |
|---|---|---|---|---|
| 5,108,092 | A | 4/1992 | Hurst | |
| 2002/0151412 | A1* | 10/2002 | Lee | A63B 22/0056 482/52 |
| 2008/0171641 | A1* | 7/2008 | Chang | A63B 22/0664 482/54 |
| 2008/0194388 | A1* | 8/2008 | Chen | A63B 22/0664 482/52 |
| 2011/0039661 | A1 | 2/2011 | Long | |
| 2019/0232106 | A1 | 8/2019 | Dalmia et al. | |
| 2022/0362628 | A1* | 11/2022 | Polinsky | A63B 22/0664 |

FOREIGN PATENT DOCUMENTS

| | | | |
|---|---|---|---|
| JP | H10-094577 | A | 4/1998 |
| TW | M307427 | U | 6/1997 |

* cited by examiner

*Primary Examiner* — Zachary T Moore
(74) *Attorney, Agent, or Firm* — Oliff PLC

(57) ABSTRACT

A pedaling exercise device includes a rotation mechanism configured to pivotally support a rotation shaft to allow rotation, a pair of cranks having first ends connected to both ends of the rotation shaft of the rotation mechanism, respectively, a pair of links having first ends rotatably connected to second ends of the cranks, respectively, and having second ends provided with wheels, respectively, a pair of pedal portions connected to the links along a longitudinal direction of the links, respectively, a rolling surface connected to a first end of the rotation mechanism on a user side, and a restriction portion configured to restrict separation of the wheels from the upper surface of the rolling surface in a case where the first end of the rotation mechanism is lifted such that the rotation mechanism is erected in a state where a second end of the rotation mechanism is grounded.

4 Claims, 13 Drawing Sheets

PEDALING EXERCISE DEVICE

CROSS-REFERENCE TO RELATED APPLICATION

This application claims priority to Japanese Patent Application No. 2021-068525 filed on Apr. 14, 2021, incorporated herein by reference in its entirety.

BACKGROUND

1. Technical Field

The present disclosure relates to a pedaling exercise device.

2. Description of Related Art

A pedaling exercise device including a rotation mechanism that causes pedal portions to rotate in an elliptical orbit by feet of a user depressing the pedal portions is known (see Japanese Unexamined Patent Application Publication No. 10-094577 (JP 10-094577 A)).

SUMMARY

By the way, there is a demand for a pedaling exercise device that is highly convenient and easy to carry.

The present disclosure has been made to solve such a problem, and is to provide a pedaling exercise device that is highly convenient and easy to carry.

An aspect of the present disclosure relates to a pedaling exercise device including a rotation mechanism, a pair of cranks, a pair of links, a pair of pedal portions, a rolling surface, and a restriction portion. The rotation mechanism is configured to pivotally support a rotation shaft to allow rotation. The cranks have first ends connected to both ends of the rotation shaft of the rotation mechanism, respectively, extend in a radial direction of the rotation shaft, and are configured to rotate about the rotation shaft. The links have first ends rotatably connected to second ends of the cranks, respectively, and have second ends provided with wheels, respectively. The pedal portions are connected to the links along a longitudinal direction of the links, respectively, and are configured to rotate in an elliptical orbit about the rotation shaft, respectively, by feet of a user depressing the pedal portions. The rolling surface is connected to a first end of the rotation mechanism on a user side, and have an upper surface on which the wheels roll due to rotation of the pedal portions and reciprocation of the second ends of the links. The restriction portion is configured to restrict separation of the wheels from the upper surface of the rolling surface in a case where the first end of the rotation mechanism is lifted such that the rotation mechanism is erected in a state where a second end of the rotation mechanism is grounded.

In this aspect, an extension shaft extending in an axial direction may be connected to a central shaft of the wheels, and the restriction portion may be include an engagement portion provided on the upper surface of the rolling surface in a direction of the reciprocation and configured to be engaged with the extension shaft of the central shaft of the wheels in a case where the wheels are separated from the upper surface of the rolling surface.

In this aspect, an extension shaft extending in an axial direction may be connected to a central shaft of the wheels, and the restriction portion may include a groove portion formed on the upper surface of the rolling surface in a direction of the reciprocation, and a pin member having a first end connected to the extension shaft and a second end hooked on the groove portion, and configured to slide in the groove portion in the direction of the reciprocation.

In this aspect, the restriction portion may include an expansion and contraction portion provided in the rotation mechanism and configured to be expanded and contracted in a direction perpendicular to the longitudinal direction of the rotation mechanism, and the expansion and contraction portion may be configured to be expanded to an outer side from the rotation mechanism and restrict the separation of the wheels from the upper surface of the rolling surface in a case where the first end of the rotation mechanism is lifted such that the rotation mechanism is erected in a state where the second end of the rotation mechanism is grounded.

In this aspect, an extension shaft extending in an axial direction may be connected to a central shaft of the wheels, and the restriction portion may include a magnet member provided on the upper surface of the rolling surface in a direction of the reciprocation and configured to attract the extension shaft of the central shaft of the wheels by magnetic force.

In this aspect, the restriction portion may include a brake portion configured to stop rotation of the rotation shaft and the cranks, and rotation of the links with respect to the cranks, and the brake portion may be configured to stop the rotation of the cranks and the links and restrict the separation of the wheels from the upper surface of the rolling surface in a case where the first end of the rotation mechanism is lifted such that the rotation mechanism is erected in a state where the second end of the rotation mechanism is grounded.

In this aspect, the restriction portion may include a connection member configured to put the second ends of the links and the rolling surface into a connected state or a disconnected state.

In this aspect, the rolling surface may be provided with a handle portion for lifting the first end of the rotation mechanism, and the handle portion may include an expansion and contraction mechanism that be expanded and contracted in an up-down direction.

According to the present disclosure, it is possible to provide the pedaling exercise device that is highly convenient and easy to carry.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Embodiment 1

Figure 1:
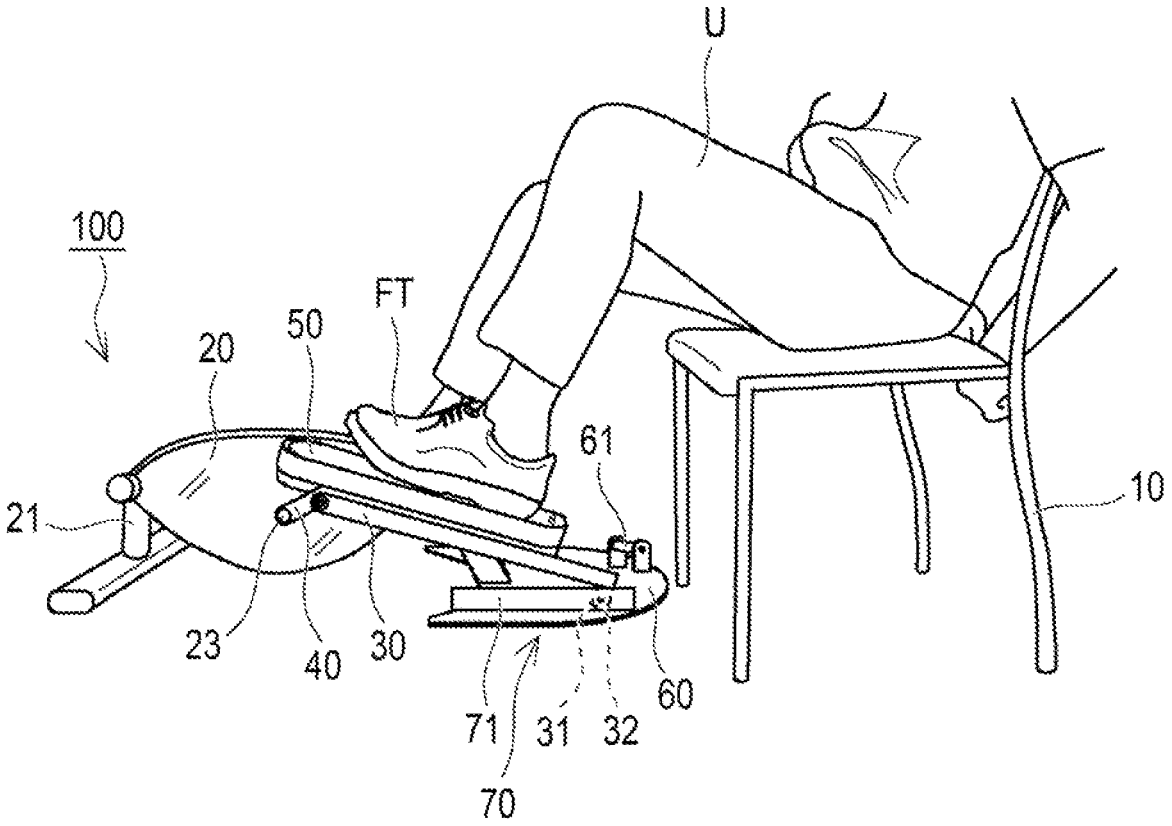
FIG. 1 is a side view of a pedaling exercise device according to the present embodiment.

In the following, the present disclosure will be described through embodiments of the disclosure, but the disclosure according to the claims is not limited to the embodiments described below. In addition, all the configurations described in the embodiments are not always needed as means for solving the problem. In order to clarify the description, the following description and drawings have been omitted or simplified as appropriate. In each drawing, the same elements are designated by the same reference numerals, and duplicate descriptions are omitted as needed.

In the following, an embodiment of the present disclosure will be described with reference to the drawings. FIG. 1 is a side view of a pedaling exercise device according to the present embodiment.

A pedaling exercise device 100 according to the present embodiment is an exercise device by which various parts, such as legs, abdomen, and buttocks, of a user U can be trained by performing a pedaling exercise by the user U. The pedaling exercise device 100 according to the present embodiment will be described with reference to FIG. 1. It should be noted that, in the following description, a front-rear direction, a right-left direction, and an up-down direction are directions based on a direction of the user U.

As shown in FIG. 1, the pedaling exercise device 100 includes a seat portion 10, a rotation mechanism 20, a pair of links 30, a pair of cranks 40, a pair of pedal portions 50, and a rolling surface 60. The seat portion 10 is disposed on a first end side (rear end) of the rotation mechanism 20. The seat portion 10 may be configured as, for example, a chair on which the user U sits. The user U performs the pedaling exercise in a state of sitting on the seat portion 10.

It should be noted that the seat portion 10 may be provided integrally with the rotation mechanism 20 or may be provided as a separate body. The seat portion 10 may be provided to be attachable and detachable on the rotation mechanism 20. For example, the seat portion 10 may be a chair in a facility or home at which the user U is located. That is, the user U or an assistant may install the seat portion 10 in the rear of the rotation mechanism 20.

In the pedaling exercise device 100, the link 30, the crank 40, and the pedal portion 50 are attached to each of the right and left sides of the rotation mechanism 20 as a center. A substantially T-shaped support portion 21 is provided at a second end (front end) of the rotation mechanism 20. For example, a pair of wheels for moving the pedaling exercise device 100 may be rotatably attached to both right and left ends and the front of the support portion 21, respectively. The support portion 21 is grounded to a floor surface or the like to support the front end of the rotation mechanism 20.

The rotation mechanism 20 pivotally supports a rotation shaft 23 to allow rotation. A first end of the crank 40 is connected to each of the right and left ends of the rotation shaft 23 of the rotation mechanism 20. The cranks 40 are formed in a substantially rod shape, extend in a radial direction of the rotation shaft 23, and rotate about the rotation shaft 23.

The rotation mechanism 20 may include a load resistor that applies a load to a rotational movement of the rotation shaft 23 and the cranks 40. It should be noted that the rotation mechanism 20 may include a gear or the like for making the load variable. By changing the load of the rotation mechanism 20, an exercise load of the pedaling exercise device 100 can be changed.

The links 30 are formed in a substantially rod shape. A second end of the crank 40 is rotatably connected to a first end of the link 30. For example, the first end of the link 30 is connected to the second end of the crank 40 via a bearing or the like. Wheels 31 are rotatably provided at a second end of the link 30. The wheels 31 are attached to the second end of the link 30 via a central shaft 32.

The pedal portions 50 are connected to an upper surface of the links 30 along a longitudinal direction of the link 30. The pedal portions 50 and the links 30 may be integrally configured. The pedal portions 50 are steps on which the user U puts feet FT. The sitting user U puts the feet FT on the pedal portions 50. The pedal portions 50 may be provided with fixing portions, such as straps, for fixing the feet.

The user U puts the feet FT on the pedal portions 50 and performs the pedaling exercise. That is, the user U depresses the pedal portions 50 by the feet FT while moving a knee joint or a hip joint. As a result, the cranks 40 rotate about the rotation shaft 23. Further, an angle between the link 30 and the crank 40 is changed in response to the rotation of the crank 40.

That is, a relative angle of the link 30 with respect to the crank 40 is changed in response to a rotation angle (also referred to as a crank angle) of the crank 40. In addition, the wheels 31 of the links 30 roll on the upper surface of the rolling surface 60 and reciprocate in the front-rear direction. As a result, the cranks 40 and the links 30 rotate in response to the pedaling exercise such that the pedal portions 50 draw an elliptical orbit.

It should be noted that the pedal portion 50, the link 30, and the crank 40 are provided for each of the right and left feet FT of the user U. That is, the pedal portion 50, the link 30, and the crank 40 are provided on each of the right and left sides of the rotation mechanism 20. The pedal portion 50, the link 30, and the crank 40 provided on the right side of the rotation mechanism 20 correspond to a right foot FT of the user U. The pedal portion 50, the link 30, and the crank 40 provided on the left side of the rotation mechanism 20 correspond to a left foot FT of the user U.

The cranks 40 are attached to the rotation shaft 23 of the rotation mechanism 20 so as to be in an opposite phase with respect to the right and left feet FT. That is, the rotation angle of the crank 40 for the left foot and the rotation angle of the crank 40 for the right foot are deviated by 180°. The user U alternately expands and contracts a left leg and a right leg to perform the pedaling exercise. It should be noted that the cranks 40 may be attached to the rotation shaft 23 of the rotation mechanism 20 so as to have the same phase with respect to the right and left feet FT.

While the user U performs the pedaling exercise in a direction of expanding the right leg and bending the left leg, the wheel 31 of the link 30 on the right side is moved forward, and the wheel 31 of the link 30 on the left side is moved rearward. While the user U performs the pedaling exercise in a direction of expanding the left leg and bending the right leg, the wheel 31 of the link 30 on the left side is moved forward, and the wheel 31 of the link 30 on the right side is moved rearward.

The rolling surface 60 is connected to the rear end of the rotation mechanism 20. The rolling surface 60 is, for example, a plate-shaped member, is grounded to the ground and supports the rear end of the rotation mechanism 20. That is, the front end and the rear end of the rotation mechanism 20 are supported by the support portion 21 and the rolling surface 60.

The rolling surface 60 is fixed to the rotation mechanism 20 so as to be substantially parallel to the rotation mechanism 20. The pedal portions 50 rotate and the second end of the link 30 reciprocate in the front-rear direction, so that the wheels 31 of the links 30 roll on the upper surface of the rolling surface 60. At an end portion of the upper surface of the rolling surface 60, a handle portion 61 is provided to be gripped when the user moves the pedaling exercise device 100.

In a case where the user moves the pedaling exercise device 100, wheels of the support portion 21 of the rotation mechanism 20 are grounded, the handle portion 61 on a rear end side is lifted upward such that the rotation mechanism 20 is erected with the wheels as a fulcrum, and the pedaling exercise device 100 is moved.

However, in the related art, in a case where the handle portion on the rear end side is lifted upward such that the rotation mechanism is erected in a state where the support portion of the rotation mechanism is grounded as described above, the cranks and the links may rotate to a front end side about the rotation shaft and the wheels may be separated from the upper surface of the rolling surface, and thus there is a problem that the pedaling exercise device is unstable and difficult to carry.

On the other hand, the pedaling exercise device 100 according to the present embodiment includes a restriction portion 70 that restricts the separation of the wheels 31 of the links 30 from the upper surface of the rolling surface 60 in a case where the handle portion 61 at the rear end is lifted in a state where the front end of the rotation mechanism 20 is grounded. As a result, the cranks 40 and the links 30 do not rotate about the rotation shaft 23 toward the front end side, so that the wheels 31 of the links 30 are not separated from the upper surface of the rolling surface 60. Therefore, it is possible to stabilize and easily carry the pedaling exercise device 100.

Figure 2:
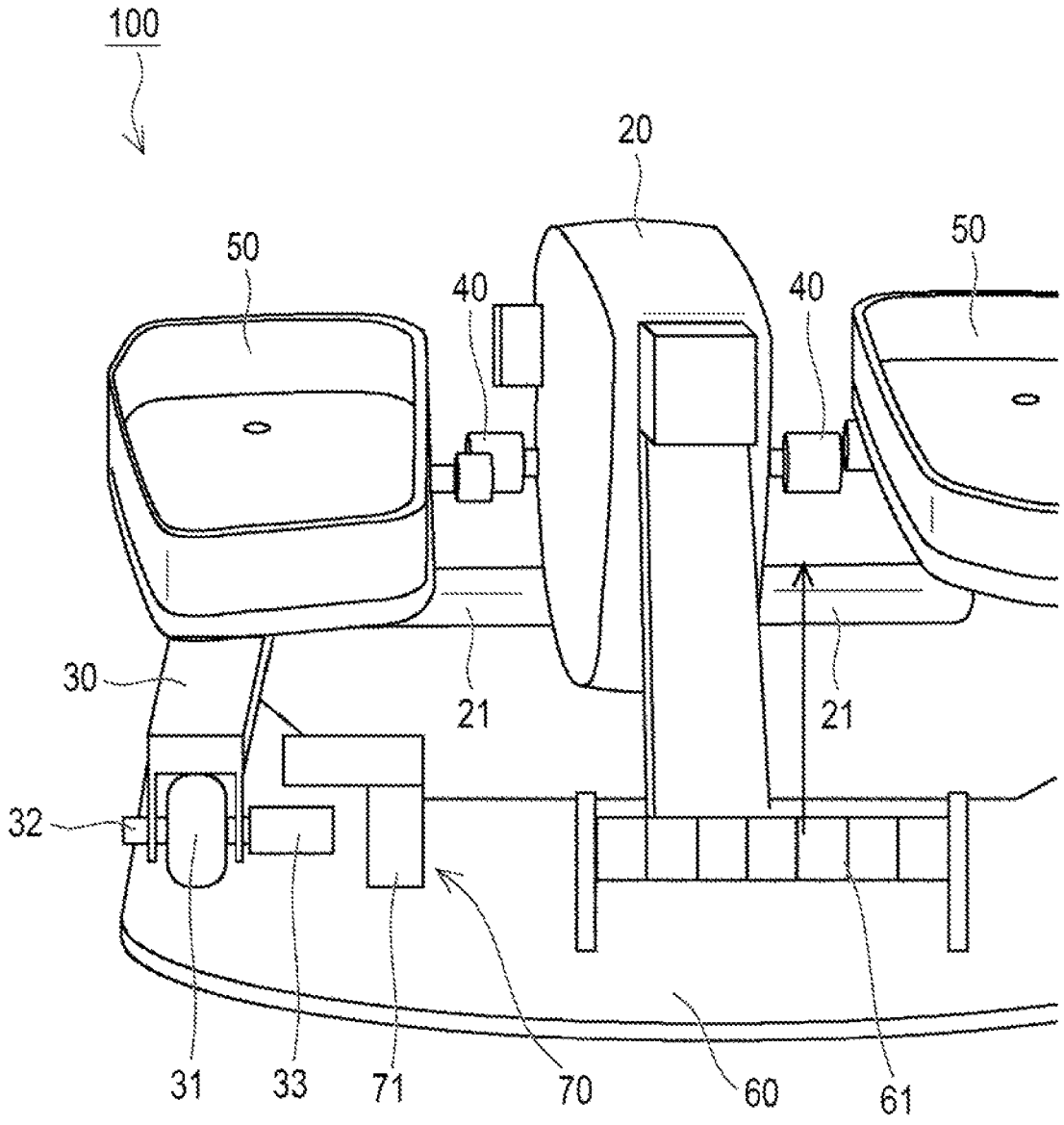
FIG. 2 is a rear view of a restriction portion.

As shown in FIG. 1, the restriction portion 70 includes an engagement portion 71 provided on the upper surface of the rolling surface 60 in a direction of reciprocation (front-rear direction) of the wheels 31 of the links 30. FIG. 2 is a rear view of the restriction portion. It should be noted that, in FIG. 2, the restriction portion 70 is schematically shown for easy understanding. In addition, in FIG. 2, solely the restriction portion 70 on the left side is shown, but the restriction portion 70 similar to the restriction portion 70 on the left side is also provided on the right side of the rolling surface.

An extension shaft 33 extending in an axial direction is connected to the central shaft 32 of the wheels 31 of the links 30. The extension shaft 33 extends to a rotation mechanism side (inner side). The central shaft 32 and the extension shaft 33 may be integrally formed as one shaft.

In a case where the wheels 31 of the links 30 are separated from the upper surface of the rolling surface 60, the extension shaft 33 of the central shaft 32 of the wheels 31 hits and is engaged with the engagement portion 71. The engagement portion 71 is configured as a rail formed to have a substantially inverted L-shaped cross section.

In a case where the wheels 31 of the links 30 are separated from the upper surface of the rolling surface 60, an upper portion of the extension shaft 33 of the central shaft 32 of the wheels 31 hits and is engaged with a lower surface of the engagement portion 71 having an inverted L-shape. As a result, it is possible to restrict the separation of the wheels 31 from the upper surface of the rolling surface 60.

Figure 3:
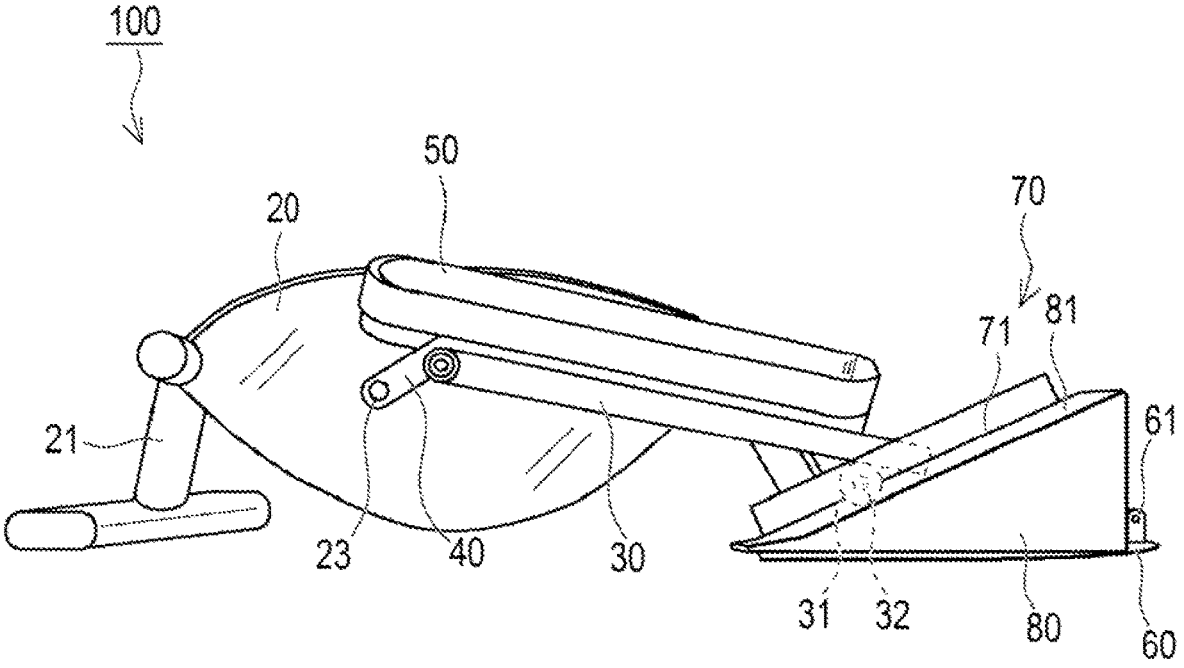
FIG. 3 is a diagram showing a configuration in which a tilting table is provided on a rolling surface.

As shown in FIG. 3, a tilting table 80 may be provided on the rolling surface 60. A height of a tilting surface 81 of the tilting table 80 becomes higher toward a user side. A heights of the wheel 31 of the link 30 is changed along the tilting surface 81 of the tilting table 80. The angle of the link 30 is changed depending on the height of the wheel 31, and a joint angle of the foot is changed. Therefore, by adjusting a tilting angle of the tilting table 80, the user U can perform the pedaling exercise at joint angle of the foot suitable for each user U.

In a case where the tilting table 80 is provided on the rolling surface 60 as described above, the engagement portion 71 with which the extension shaft 33 of the central shaft 32 of the wheels 31 is engaged may be provided on the tilting surface 81 of the tilting table 80. The engagement portion 71 is provided on the tilting surface 81 of the tilting table 80 in the direction of reciprocation of the wheels 31 of the links 30.

As a result, even in a case where the tilting table 80 is provided, when the handle portion 61 at the rear end is lifted such that the rotation mechanism 20 is erected in a state where the front end of the rotation mechanism 20 is grounded, it is possible to restrict the separation of the wheels 31 from the tilting surface 81 of the tilting table 80.

Figure 4:
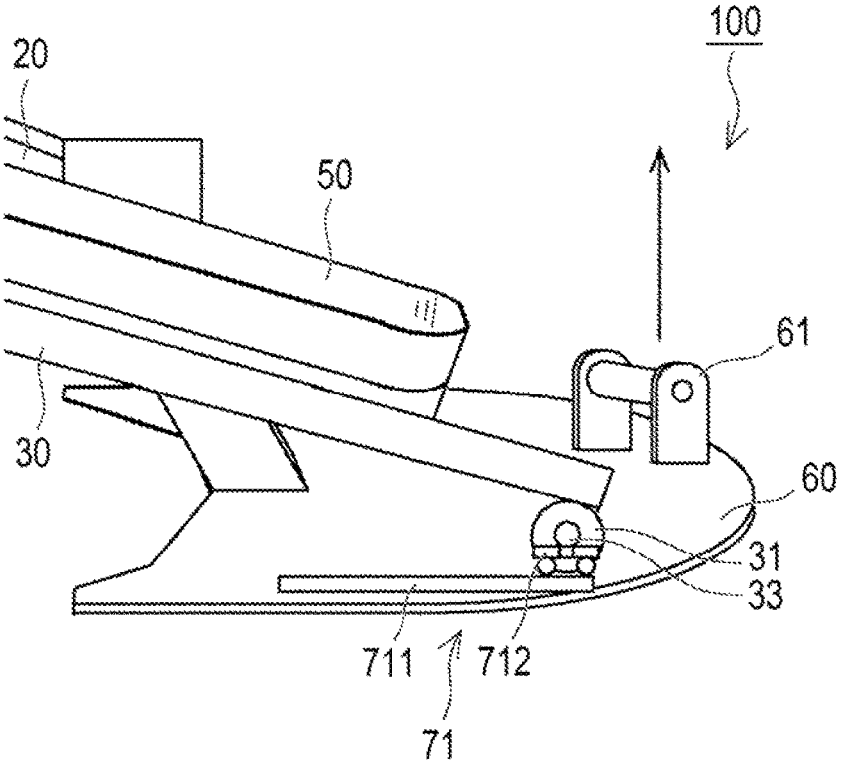
FIG. 4 is a diagram showing a linear guide mechanism.

It should be noted that the engagement portion 71 may be configured as a linear guide mechanism as shown in FIG. 4. In FIG. 4, the linear guide mechanism is schematically shown for easy understanding. The linear guide mechanism includes a linear guide portion 711 formed in a rail shape in the front-rear direction on the rolling surface 60, and a block portion 712 that slides on the linear guide portion 711 along a longitudinal direction of the linear guide portion 711.

A pin or the like may be provided on the extension shaft 33 of the central shaft 32 of the wheels 31 of the links 30. The pin of the extension shaft 33 may be fitted into the block portion 712 of the linear guide mechanism. As a result, when the wheels 31 of the links 30 reciprocate in the front-rear direction, the block portion 712 slides on the linear guide portion 711.

The pin of the extension shaft 33 of the wheel 31 of the link 30 is fitted into and engaged with the block portion 712 of the linear guide mechanism. As a result, it is possible to restrict the separation of the wheels 31 of the links 30 from the upper surface of the rolling surface 60.

It should be noted that a frictional force sufficient for preventing the pin of the extension shaft 33 from coming off the block portion 712 of the linear guide mechanism is applied between the pin of the extension shaft 33 and the block portion 712 of the linear guide mechanism. For example, the pin of the extension shaft 33 may be deeply inserted in the block portion 712 of the linear guide mechanism.

The pin of the extension shaft 33 of the wheels 31 of the links 30 may be engaged by magnetizing the block portion 712 of the linear guide mechanism, or may be engaged by another means.

Further, in a case where the tilting table 80 is provided on the rolling surface 60 as described above, the linear guide mechanism may be provided on the tilting surface 81 of the tilting table 80. In this case, an extension shaft extending to an outer side (side opposite to the rotation mechanism 20) may be further connected to the central shaft 32 of the wheels 31 of the links 30. The central shaft 32 and the extension shaft may be integrally formed as one shaft.

In a case where the tilting table 80 is provided on the rolling surface 60, when the wheels 31 reciprocate on the tilting surface 81 in the front-rear direction, the block portion 712 slides on the linear guide portion 711. Further, the pin of the extension shaft 33 of the wheel 31 of the link 30 is fitted into and engaged with the block portion 712 of the linear guide mechanism. As a result, it is possible to restrict the separation of the wheels 31 of the links 30 from the tilting surface 81 of the tilting table 80.

The engagement portion 71 may be configured as a magnet. The magnet may be provided on the upper surface of the rolling surface 60 in the direction of reciprocation (front-rear direction) of the wheels 31 of the links 30. The magnet on the rolling surface 60 attracts the extension shaft 33 of the wheels 31 of the links 30 toward the rolling surface 60. As a result, in a case where the handle portion 61 at the rear end is lifted such that the rotation mechanism 20 is erected, it is possible to restrict the separation of the wheels 31 from the tilting surface 81 of the tilting table 80.

Figure 5:
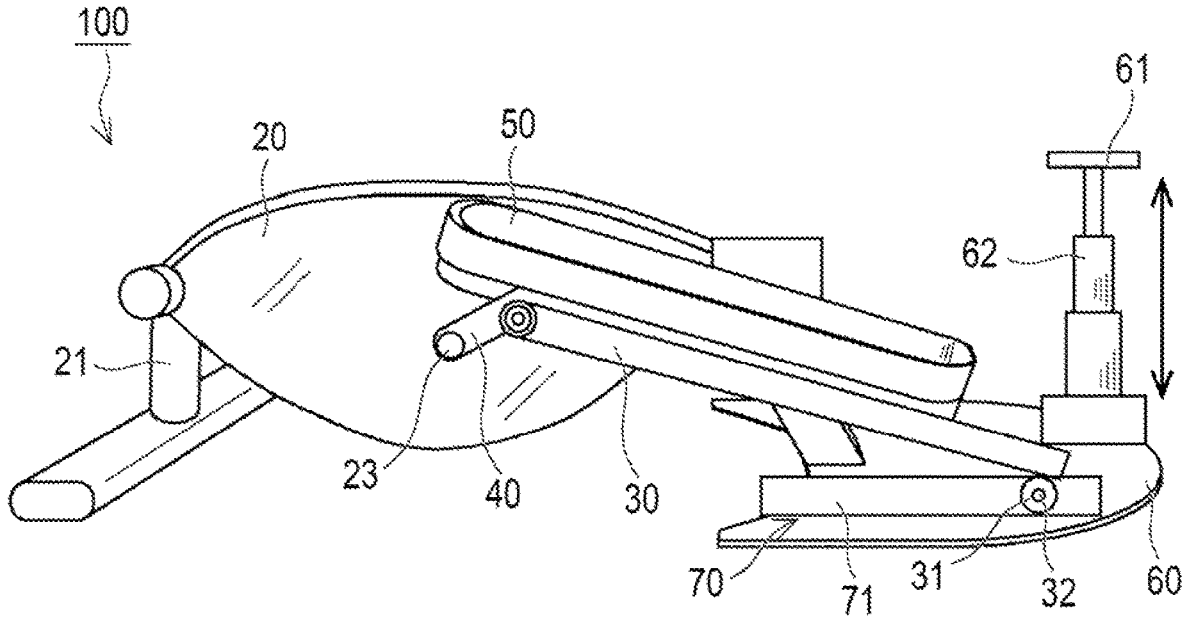
FIG. 5 is a diagram showing an expansion and contraction mechanism of a handle portion.

As shown in FIG. 5, the handle portion 61 may include an expansion and contraction mechanism 62 that is expanded and contracted in the up-down direction. It should be noted that, in FIG. 5, the handle portion 61 and the expansion and contraction mechanism 62 are schematically shown for easy understanding. By expanding the expansion and contraction mechanism 62 of the handle portion 61 upward, the user can move the rotation mechanism 20 in a comfortable posture in a state of lifting the first end side of the rotation mechanism 20 low.

Embodiment 2

Figure 6:
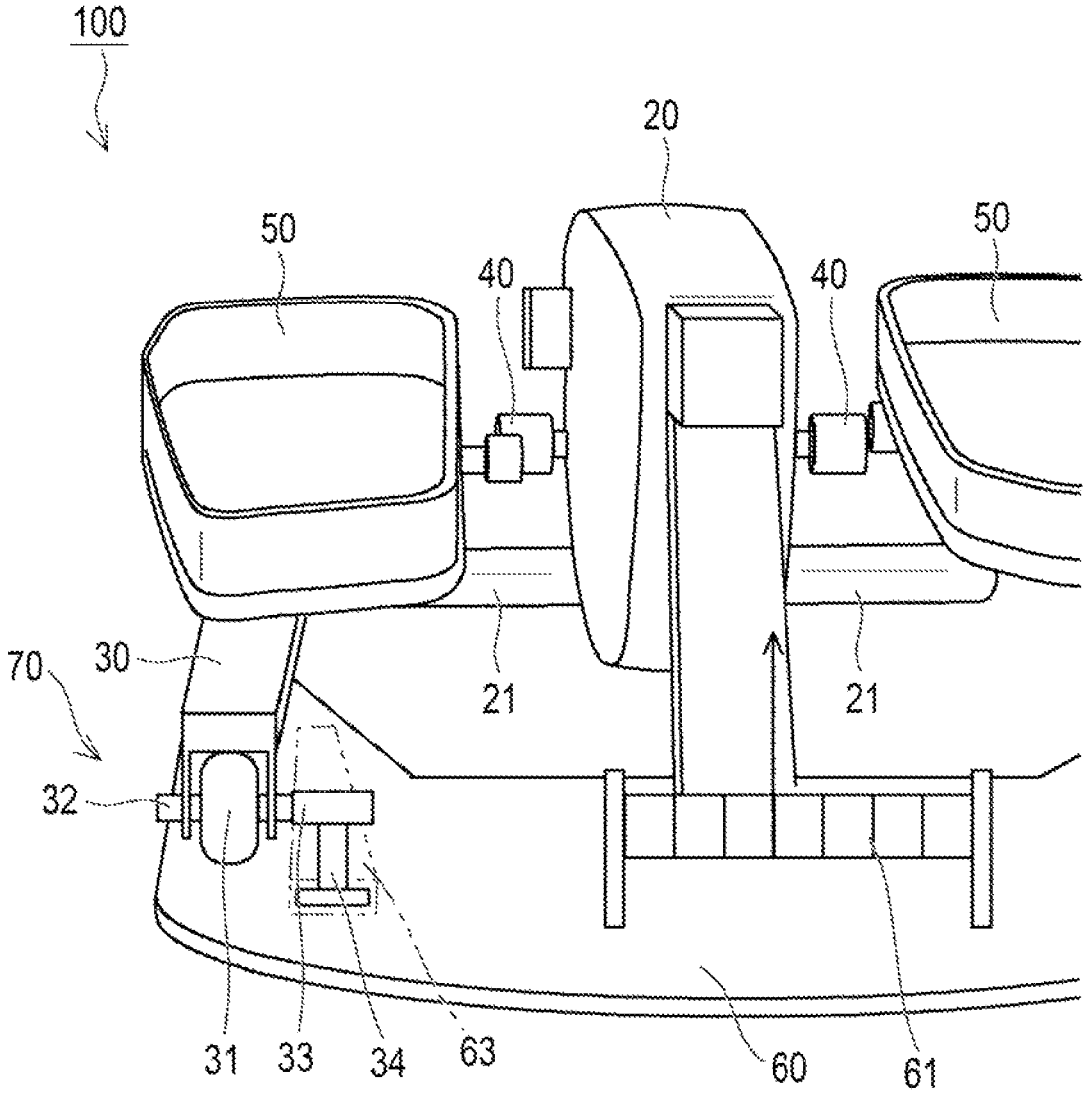
FIG. 6 is a diagram showing the restriction portion according to the present embodiment.

FIG. 6 is a diagram showing the restriction portion according to the present embodiment. In the present embodiment, the restriction portion 70 may be configured to have a groove portion 63 formed on the rolling surface 60 and a pin member 34 connected to the extension shaft 33 of the central shaft 32 of the wheels 31 of the links 30.

Figure 7:
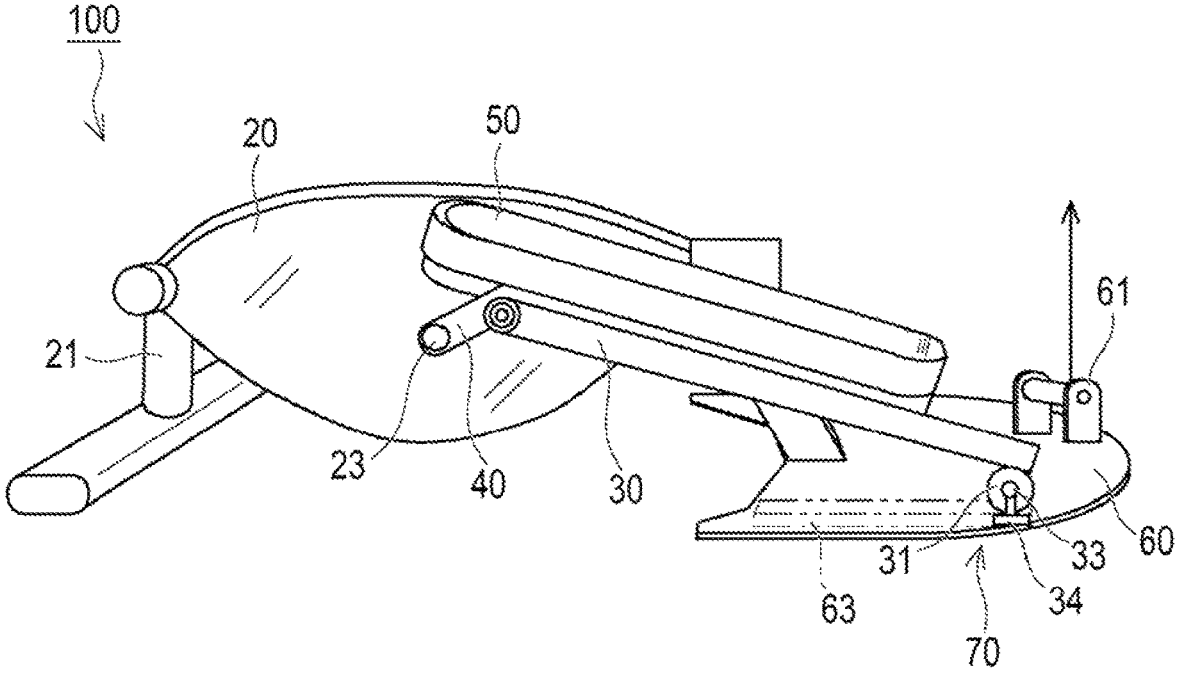
FIG. 7 is a diagram showing a groove portion of the rolling surface.

As shown in FIG. 7, the groove portion 63 is formed on the rolling surface 60 in the direction of reciprocation of the wheels 31. A first end of the pin member 34 is connected to the extension shaft 33 of the central shaft 32 of the wheels 31 of the links 30. A second end of the pin member 34 is inserted in the groove portion 63 and is hooked on the groove portion 63. As a result, in a case where the handle portion 61 at the rear end is lifted such that the rotation mechanism 20 is erected, it is possible to restrict the separation of the wheels 31 from the rolling surface 60. Moreover, in conjunction with the reciprocation of the wheels 31 of the links 30, the pin member 34 also slides in the groove portion 63 in the direction of reciprocation.

Figure 8A:
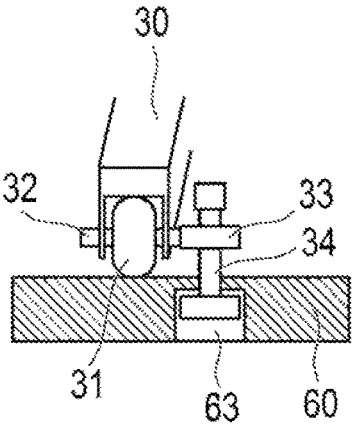
FIG. 8A is a diagram showing an example of a pin member.
Figure 8B:
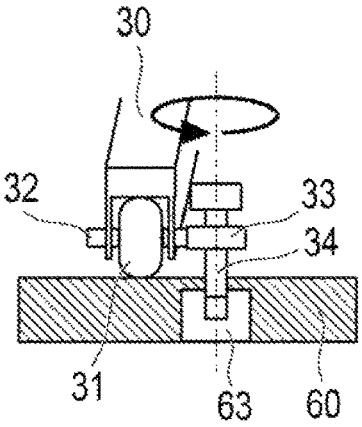
FIG. 8B is a diagram showing an example of a pin member.
Figure 8C:
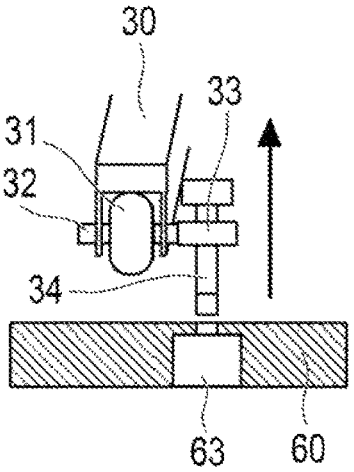
FIG. 8C is a diagram showing an example of a pin member.

FIG. 8A, FIG. 8B and FIG. 8C are diagrams showing examples of the pin member. The second end of the pin member 34 may be formed in a T-shape, for example, as shown in FIGS. 8A to 8C. From a state (FIG. 8A) where the second end of the pin member 34 is hooked on the groove portion 63, the pin member 34 is caused to rotate about an axis of a dotted line and put into a state (FIG. 8B) where the second end of the pin member 34 is not hooked on the groove portion 63. As a result, the second end of the pin member 34 can be extracted from the groove portion 63 (FIG. 8C).

Figure 9:
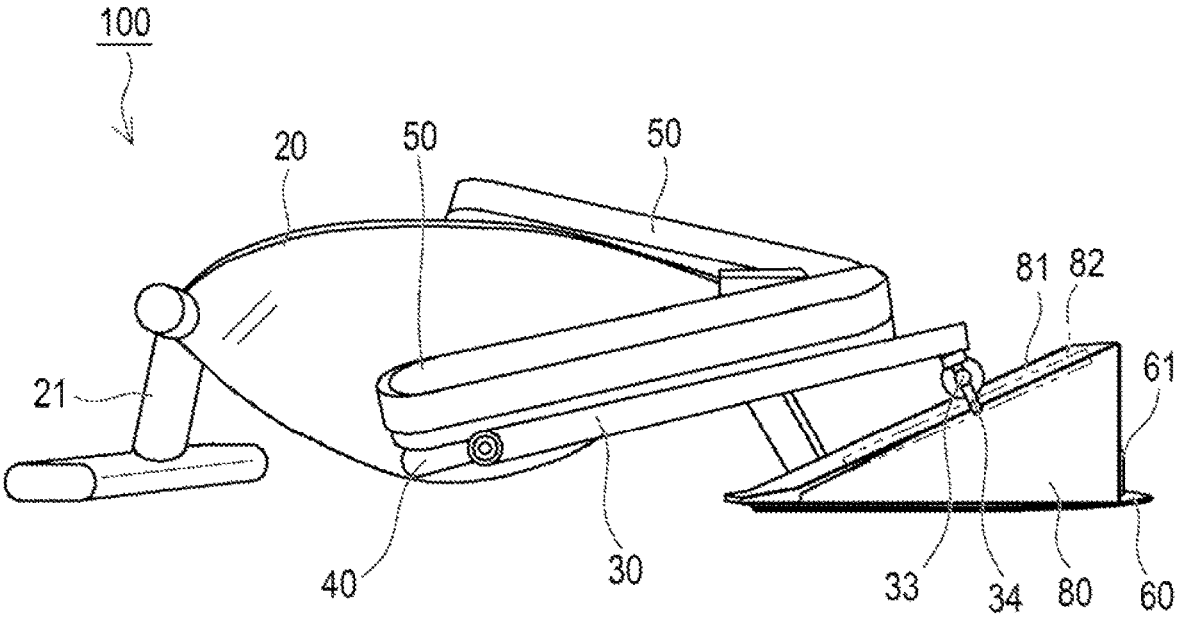
FIG. 9 is a diagram showing the groove portion formed on the tilting table of the rolling surface.

For example, as shown in FIG. 9, the tilting table 80 may be provided on the rolling surface 60, and a groove portion 82 may be formed along the tilting surface 81. In this case, as shown in FIGS. 8A to 8C, the second end of the pin member 34 is extracted from the groove portion 63 of the rolling surface 60. Moreover, as shown in FIG. 9, after the tilting table 80 is installed on the rolling surface 60, the extracted second end of the pin member 34 is inserted in the groove portion 82 of the tilting table 80 and caused to rotate. As a result, it is possible to put the second end of the pin member 34 into a state of being hooked on the groove portion 82. In this way, even in a case where the tilting table 80 is installed on the rolling surface 60, it is possible to easily restrict the separation of the wheels 31 from the tilting surface 81 of the tilting table 80.

Embodiment 3

Figure 10:
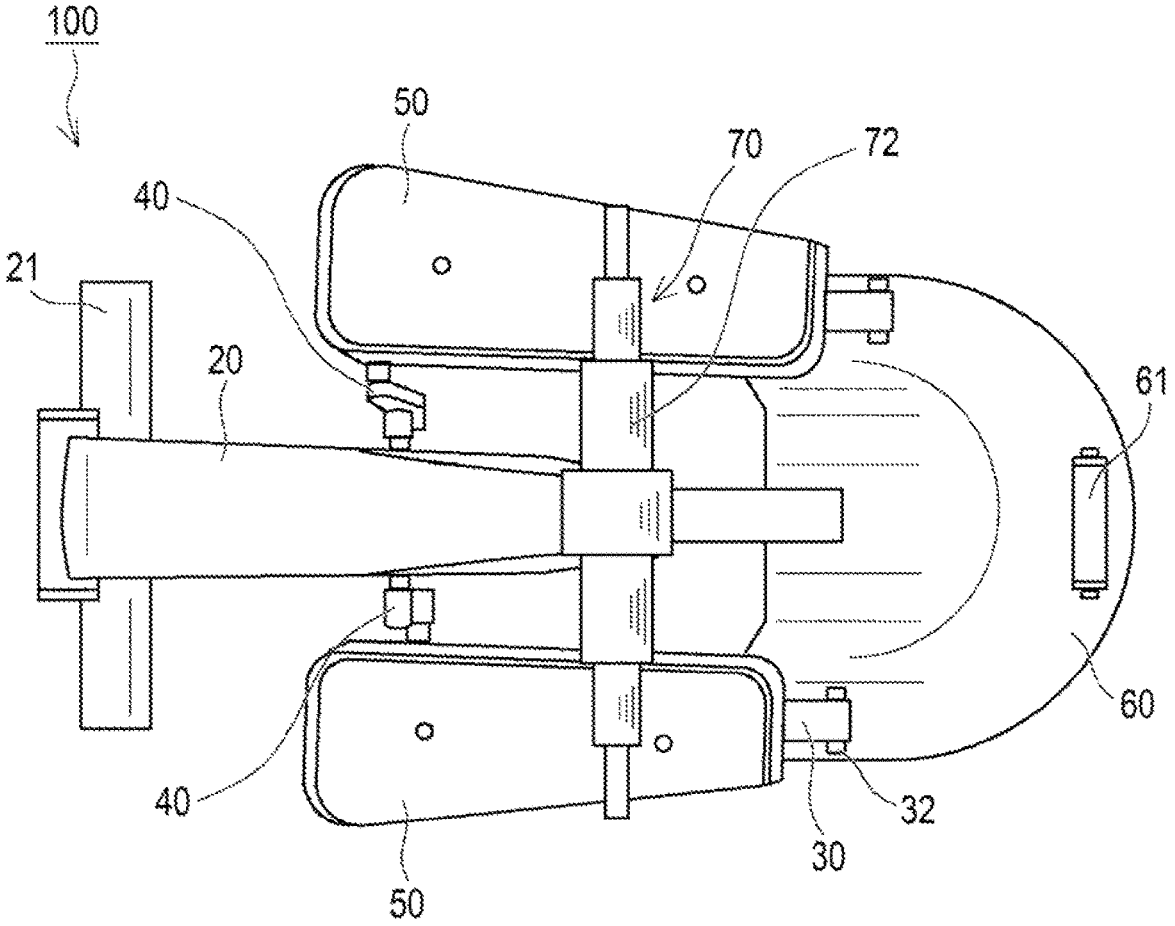
FIG. 10 is a top view showing the restriction portion according to the present embodiment.

FIG. 10 is a top view showing the restriction portion according to the present embodiment. In the present embodiment, the restriction portion 70 is provided in the rotation mechanism 20 and includes an expansion and contraction portion 72 that is expanded and contracted in a direction perpendicular to the longitudinal direction of the rotation mechanism 20. The expansion and contraction portion 72 has an expansion and contraction mechanism in which a plurality of rod-shaped members is expanded and contracted in the right-left direction of the rotation mechanism 20 as a center. The expansion and contraction mechanism may be expanded and contracted by driving an actuator, such as a motor. The actuator may be driven in response to an operation of a switch provided on the rotation mechanism 20, the handle portion 61, or the like.

In a case where the user performs the pedaling exercise by using the pedaling exercise device 100, the expansion and contraction portion 72 is contracted. On the other hand, in a case where the user lifts the rear end of the rotation mechanism 20 such that the rotation mechanism 20 is erected in a state where the front end of the rotation mechanism 20 is grounded in order to carry the pedaling exercise device 100, the expansion and contraction portion 72 is expanded to the outer side from the rotation mechanism 20 as shown in FIG. 10. As a result, the pedal portions 50 are pressed from an upper side by the expansion and contraction portion 72, so that it is possible to restrict the separation of the wheels 31 from the upper surface of the rolling surface 60.

It should be noted that the rotation mechanism 20 may be provided with a sensor that detects a state where the rear end of the rotation mechanism 20 is lifted such that the rotation mechanism 20 is erected. The sensor is, for example, a contact sensor provided on a rear surface of the rolling surface 60 or the like and detecting contact with the ground. The expansion and contraction portion 72 may be automatically expanded when the state described above is detected by this sensor. Further, in the state described above, the user may operate the switch to expand the expansion and contraction portion 72, or the user may manually expand the expansion and contraction portion 72.

Embodiment 4

Figure 11:
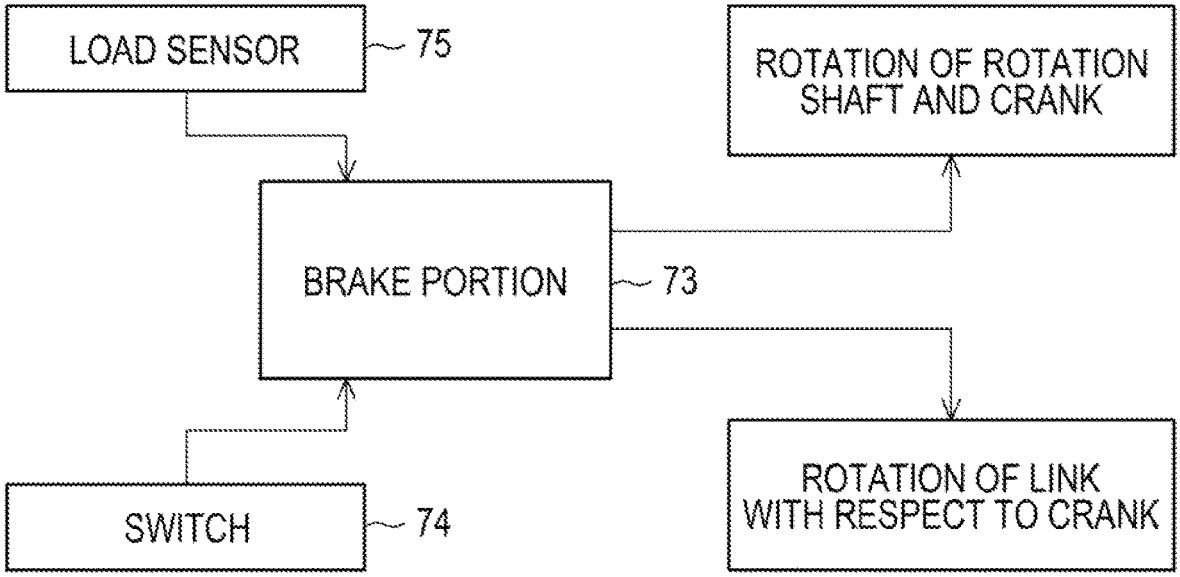
FIG. 11 is a block diagram showing a schematic system configuration of the pedaling exercise device according to the present embodiment.

FIG. 11 is a block diagram showing a schematic system configuration of the pedaling exercise device according to the present embodiment. In the present embodiment, the restriction portion 70 may include a brake portion 73 that stops the rotation of the rotation shaft 23 and the cranks 40, and the rotation of the links 30 with respect to the cranks 40.

In a case where the rear end of the rotation mechanism 20 is lifted such that the rotation mechanism 20 is erected in a state where the front end of the rotation mechanism 20 is grounded, the rotation of the cranks 40 and the links 30 is stopped, and the separation of the wheels 31 from the upper surface of the rolling surface 60 is restricted.

For example, the rotation mechanism 20 or the handle portion 61 may be provided with a switch 74 for actuating the brake portion 73. In a case where the user lifts the rear end such that the rotation mechanism 20 is erected in a state where the front end of the rotation mechanism 20 is grounded in order to carry the pedaling exercise device 100, the user operates the switch 74 to actuate the brake portion 73, and stops the rotation of the rotation shaft 23 and the cranks 40, and the rotation of the links 30 with respect to the cranks 40. As a result, it is possible to restrict the separation of the wheels 31 from the upper surface of the rolling surface 60.

It should be noted that, for example, in a case where a load is applied to the rotation of the rotation shaft 23 by the load resistor of the rotation mechanism 20 or the like and the rotation shaft 23 is difficult to rotate, the brake portion 73 may stop solely the rotation of the links 30 with respect to the cranks 40.

A load sensor 75 may be provided on the pedal portion 50. In a case where the load sensor 75 detects the load, it can be estimated a state where the user depresses the pedal portions 50 and performing the pedaling exercise. On the other hand, in a case where the load sensor 75 does not detect the load, the user is put into a state of not performing the pedaling exercise, and there is a possibility that the pedaling exercise device 100 is carried.

Therefore, in a case where the load sensor 75 does not detect the load, the brake portion 73 may be actuated to stop the rotation of the rotation shaft 23 and the cranks 40, and the rotation of the links 30 with respect to the cranks 40. As a result, it is possible to automatically detect the carrying of the pedaling exercise device 100 and reliably restrict the separation of the wheels 31 from the upper surface of the rolling surface 60.

Embodiment 5

Figure 12:
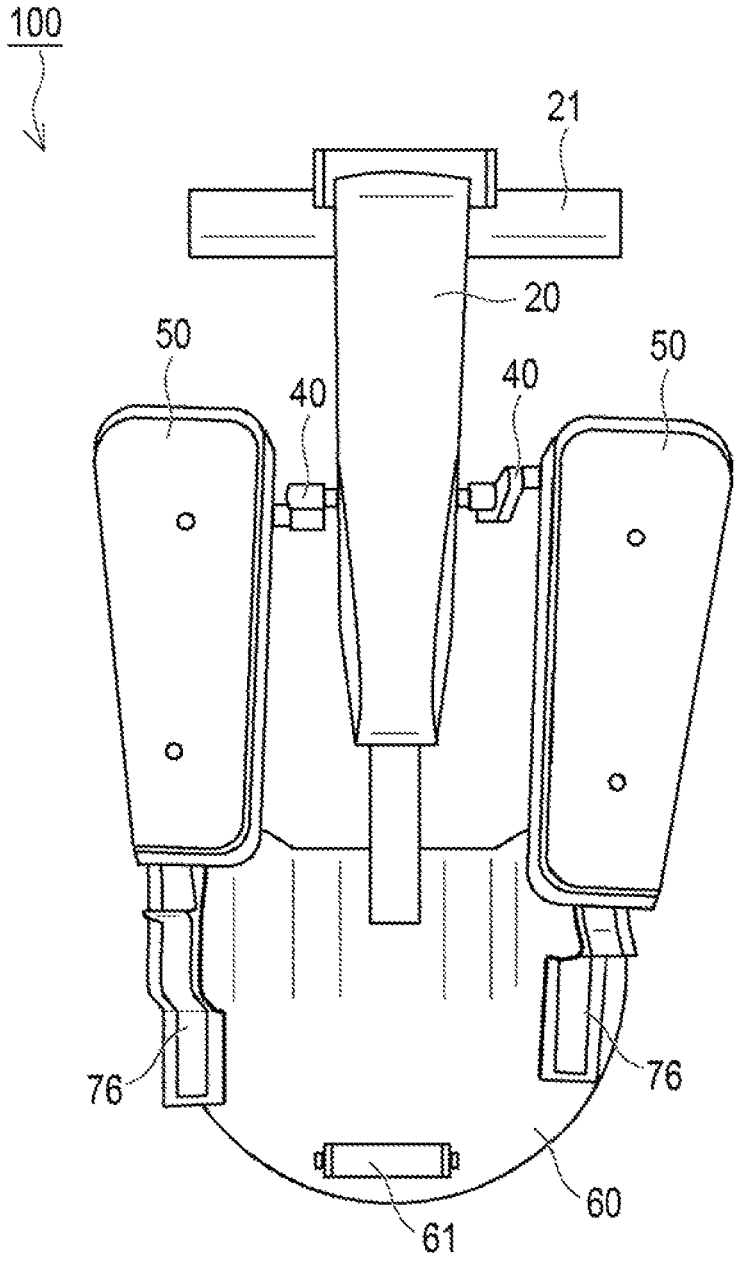
FIG. 12 is a diagram showing the restriction portion according to the present embodiment.

FIG. 12 is a diagram showing the restriction portion according to the present embodiment. In the present embodiment, the restriction portion 70 includes a connection member 76 that puts the second end of the link 30 and the rolling surface 60 into a connected state or a disconnected state. The connection member 76 may be configured as a belt-shaped hook-and-loop fastener.

For example, a female side hook-and-loop fastener is provided on each of the second end of the link 30 and the rolling surface 60. A male side hook-and-loop fastener is provided at each of both ends of the connection member 76. Moreover, the female side hook-and-loop fastener at the second end of the link 30 and the male side hook-and-loop fastener at a first end of the connection member 76 are connected. The female side hook-and-loop fastener of the rolling surface 60 and the male side hook-and-loop fastener at the second end of the connection member 76 are connected. It should be noted that the female side hook-and-loop fastener and the male side hook-and-loop fastener may be provided on opposite sides of each other.

In a case where the user lifts the rear end such that the rotation mechanism 20 is erected in a state where the front end of the rotation mechanism 20 is grounded in order to carry the pedaling exercise device 100, the male side hook-and-loop fasteners at both ends of the connection member 76 are attached to the female side hook-and-loop fasteners at the second end of the link 30 and the rolling surface 60, respectively. As a result, the second end of the link 30 and the rolling surface 60 are put into the connected state via the connection member 76, so that it is possible to restrict the separation of the wheels 31 from the upper surface of the rolling surface 60.

On the other hand, in a case where the user performs the pedaling exercise by using the pedaling exercise device 100, the male side hook-and-loop fasteners at both ends of the connection member 76 are detached from the female side hook-and-loop fasteners at the second end of the link 30 and the rolling surface 60, respectively. In this way, by attaching and detaching the connection member 76, it is possible to easily and quickly switch between a case of the pedaling exercise and a case of carrying.

Figure 13:
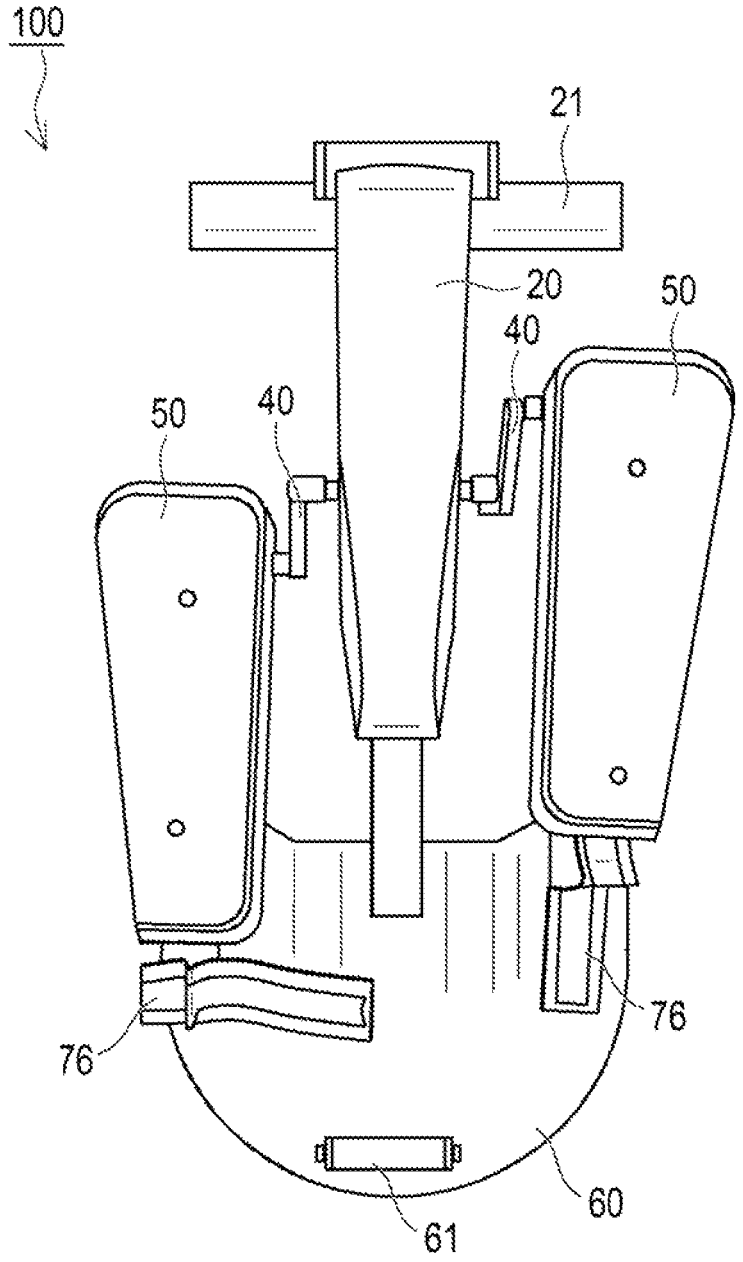
FIG. 13 is a diagram in which a fixing position of a female side hook-and-loop fastener is changed depending on a position of a crank.

It should be noted that, for example a fixing position of the female side hook-and-loop fastener on the rolling surface 60 may be changed depending on the position of the cranks 40 as shown in FIG. 13. As a result, a fixed area of the female side hook-and-loop fastener on the rolling surface 60 can be freely secured in a vacant space on the rolling surface 60.

Figure 14:
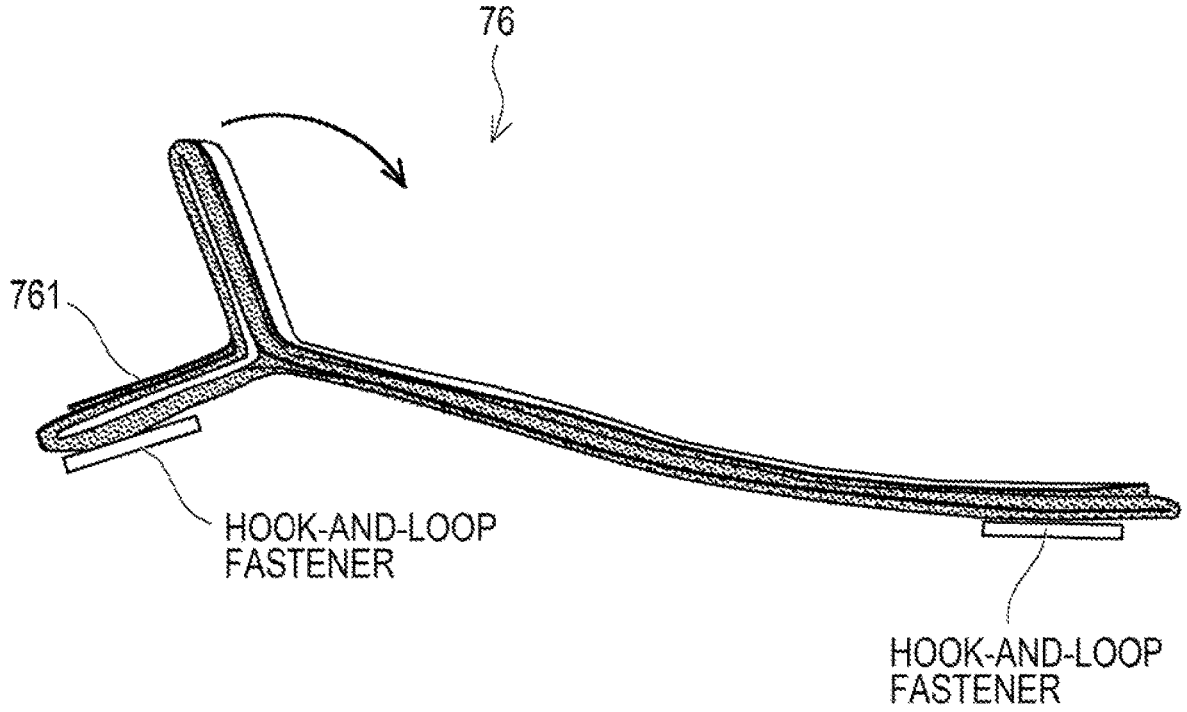
FIG. 14 is a diagram showing an example of a connection member.

FIG. 14 is a diagram showing an example of the connection member. A metal plate 761 having an L-shaped cross section may be embedded in the connection member 76. By tilting a distal end of the metal plate 761, the hook-and-loop fastener can be peeled off with a small load by using a principle of leverage.

Figure 15:
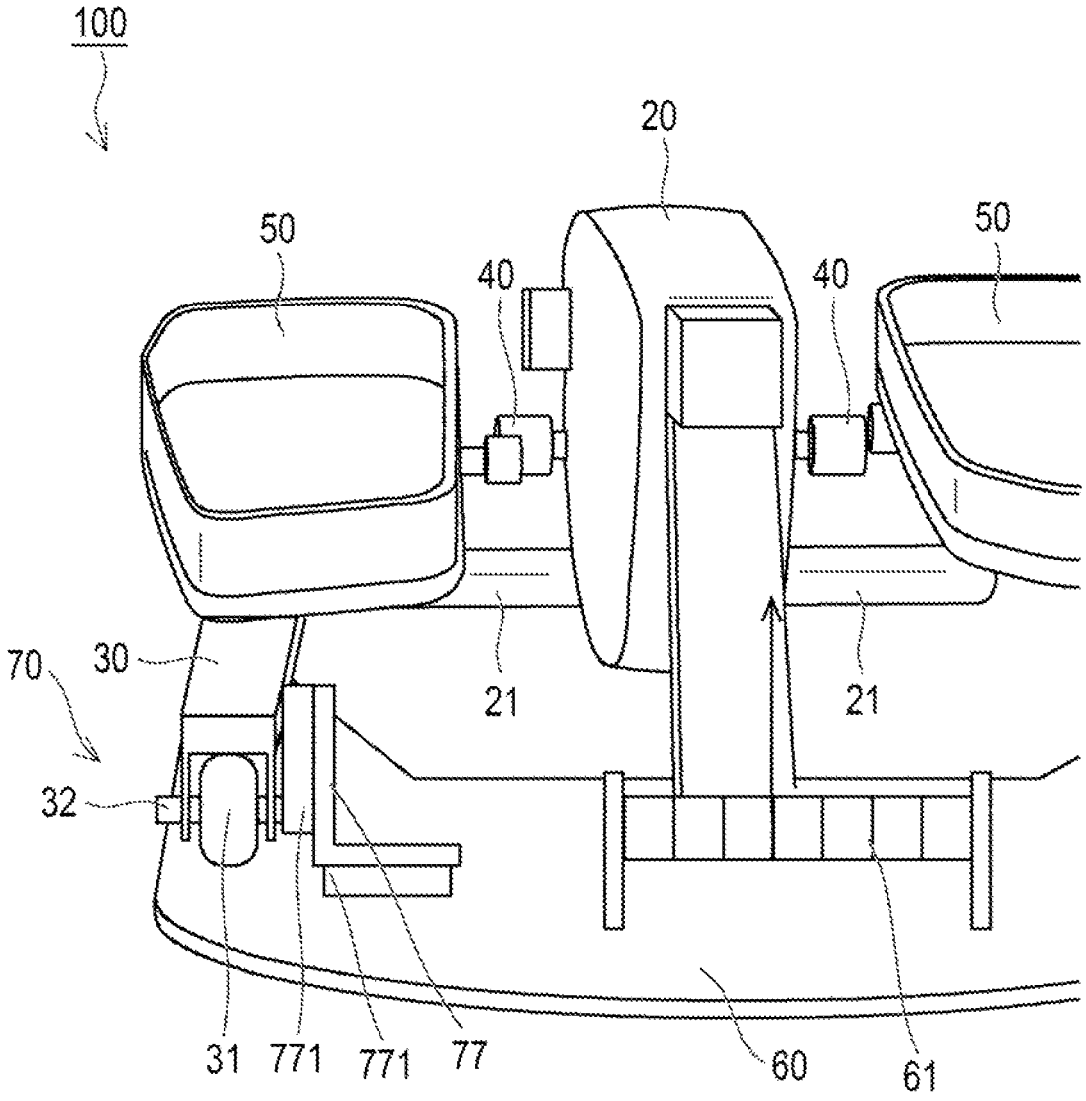
FIG. 15 is a diagram showing another example of the connection member.
Figure 16:
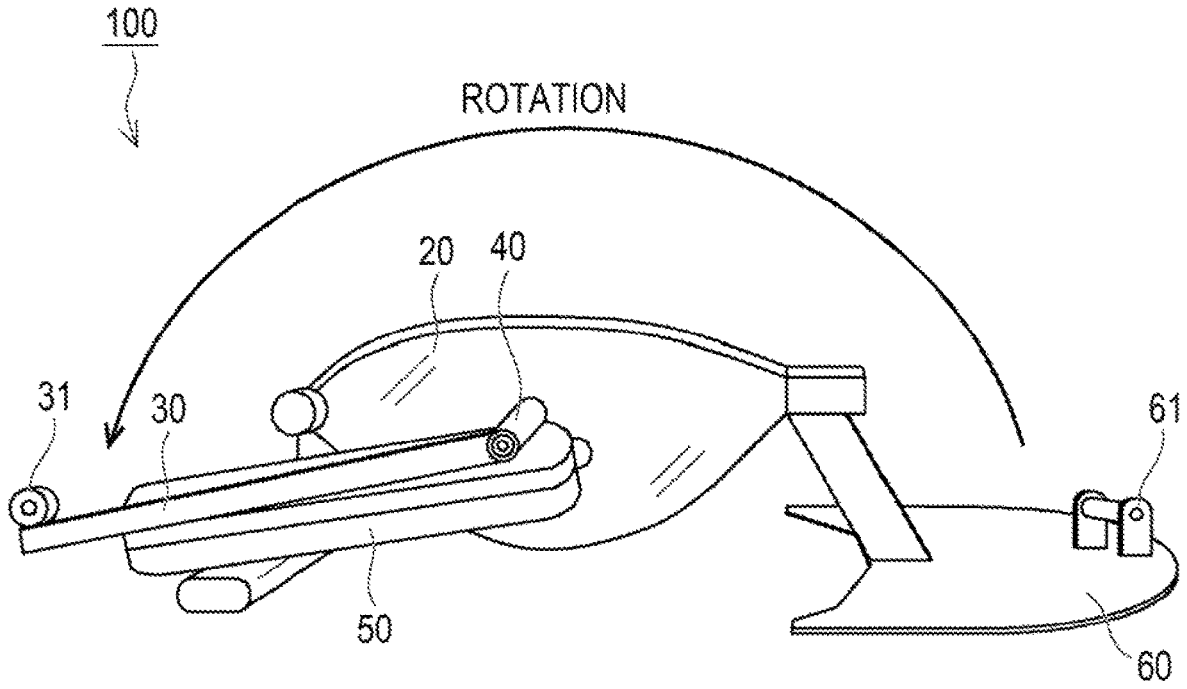
FIG. 16 is a diagram showing a state in which a second end of a link rotates by approximately 180° about a rotation shaft.

FIG. 15 is a diagram showing another example of the connection member. It should be noted that, in FIG. 15, a connection member 77 is schematically shown for easy understanding. In addition, in FIG. 15, solely the connection member 77 on the left side is shown, but the connection member 77 similar to the connection member 77 on the left side is also provided on the right side of the rolling surface. The connection member 77 may be formed to have an L-shaped cross section, and a magnet 771 may be provided at each of both ends of the connection member 77. The links 30 and the rolling surface 60 are made of a magnetic material (iron or the like).

In a case where the user lifts the rear end such that the rotation mechanism 20 is erected in a state where the front end of the rotation mechanism 20 is grounded in order to carry the pedaling exercise device 100, the magnets at both ends of the connection member 77 are magnetized at the second end of the link 30 and the rolling surface 60, respectively. As a result, the second end of the link 30 and the rolling surface 60 are put into the connected state via the connection member 77, so that it is possible to restrict the separation of the wheels 31 from the upper surface of the rolling surface 60.

Embodiment 5

In the present embodiment 5, in a case where the user carries the pedaling exercise device 100, as shown in FIG.

16, the user may rotate the second end of the link 30 by approximately 180° about the rotation shaft 23, and then may lift the handle portion 61 of the rolling surface 60 upward. At this time, in a case where the second end of the link 30 comes into contact with the ground, a component having good sliding property may be provided at a contact portion of the second end. Examples of the component having good sliding property include a hard resin material or the like.

Figure 17:
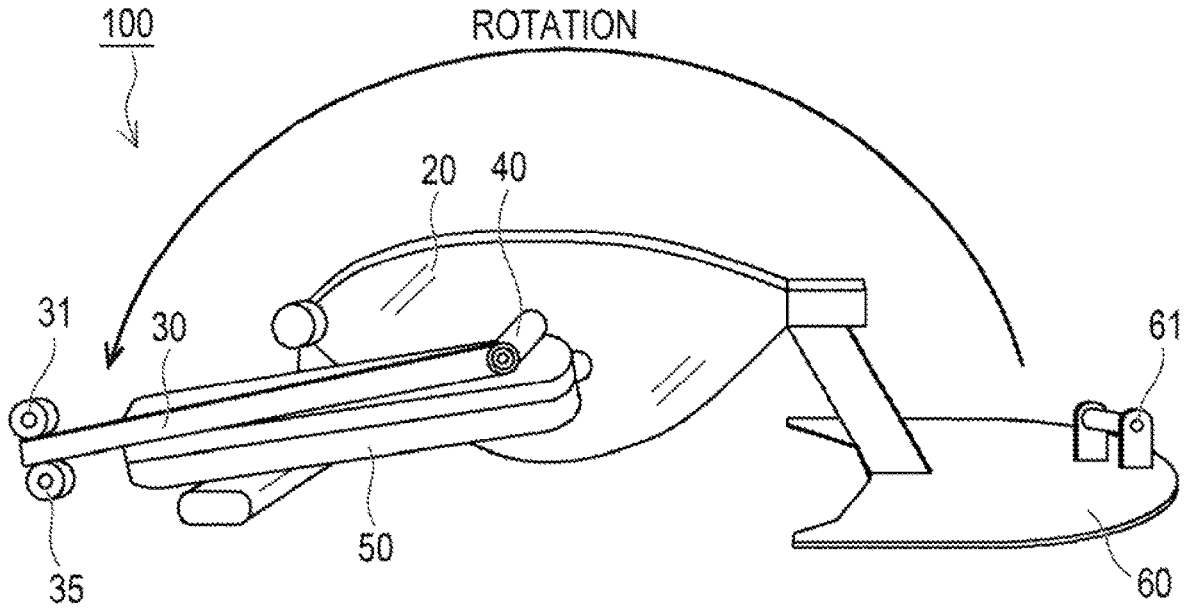
FIG. 17 is a diagram showing a configuration in which another wheel that rolls on the ground is provided on an opposite side of the link.

In addition, as shown in FIG. 17, another wheel 35 that rolls on the ground may be provided on the opposite side of the link 30 from the wheels 31 of the link 30 that rolls on the rolling surface 60. Alternatively, when a diameter of the wheel 31 of the link 30 that rolls on the rolling surface 60 is increased and the second end of the link 30 is caused to rotate by approximately 180° about the rotation shaft 23, the wheel 31 may be caused to roll on a road surface.

As described above, before the user lifts the rear end of the rotation mechanism 20 such that the rotation mechanism 20 is erected in a state where the front end of the rotation mechanism 20 is grounded in order to carry the pedaling exercise device 100, the second end of the link 30 is put into a state of rotating by approximately 180° about the rotation shaft 23. As a result, it is possible to stabilize and easily carry the pedaling exercise device 100.

Some embodiments of the present disclosure have been described. However, these embodiments are presented as examples and are not intended to limit the scope of the disclosure. These novel embodiments can be carried out in various other embodiments, and various omissions, replacements, and changes can be made without departing from the gist of the disclosure. These embodiments or modifications thereof are included in the scope or the gist of the disclosure, and are also included in the scope of the disclosure described in the claims and the equivalent scope thereof.

What is claimed is:

1. A pedaling exercise device comprising:

a rotation mechanism configured to pivotally support a rotation shaft to allow rotation;

a pair of cranks having first ends connected to both ends of the rotation shaft of the rotation mechanism, respectively, extending in a radial direction of the rotation shaft, and configured to rotate about the rotation shaft;

a pair of links having first ends rotatably connected to second ends of the cranks, respectively, and having second ends provided with wheels, respectively;

a pair of pedal portions connected to the links along a longitudinal direction of the links, respectively, and configured to rotate in an elliptical orbit about the rotation shaft, respectively, by feet of a user depressing the pedal portions;

a rolling surface connected to a first end of the rotation mechanism on a user side, and having an upper surface on which the wheels roll due to rotation of the pedal portions and reciprocation of the second ends of the links; and a restriction portion configured to restrict separation of the wheels from the upper surface of the rolling surface in a case where the first end of the rotation mechanism is lifted such that the rotation mechanism is erected in a state where a second end of the rotation mechanism is grounded, wherein the wheels have a central shaft, an extension shaft extending in an axial direction is connected to the central shaft of the wheels, and the restriction portion includes a magnet member provided on the upper surface of the rolling surface in a direction of the reciprocation and configured to attract the extension shaft of the central shaft of the wheels by magnetic force.

2. The pedaling exercise device according to claim 1, wherein the restriction portion includes:

a groove portion formed on the upper surface of the rolling surface in the direction of the reciprocation; and a pin member having a first end connected to the extension shaft and a second end hooked on the groove portion, and configured to slide in the groove portion in the direction of the reciprocation.

3. The pedaling exercise device according to claim 1, wherein the restriction portion includes a connection member configured to put the second ends of the links and the rolling surface into a connected state or a disconnected state.

4. The pedaling exercise device according to claim 1, wherein:

the rolling surface is provided with a handle portion for lifting the first end of the rotation mechanism; and the handle portion includes an expansion and contraction mechanism configured to be expanded and contracted in an up-down direction.

* * * * *